US011549274B2

(12) United States Patent
Black et al.

(10) Patent No.: US 11,549,274 B2
(45) Date of Patent: Jan. 10, 2023

(54) SUPPORT APPARATUS

(71) Applicants: John Alexander Black, Oxford (GB); Robert David Black, Oxford (GB)

(72) Inventors: John Alexander Black, Oxford (GB); Robert David Black, Oxford (GB)

(73) Assignee: Oxford Safety Components Limited, Oxfordshire (GB)

( * ) Notice: Subject to any disclaimer, the term of this patent is extended or adjusted under 35 U.S.C. 154(b) by 1270 days.

(21) Appl. No.: 15/774,236

(22) PCT Filed: Nov. 28, 2016

(86) PCT No.: PCT/GB2016/053724
§ 371 (c)(1),
(2) Date: May 7, 2018

(87) PCT Pub. No.: WO2017/089829
PCT Pub. Date: Jun. 1, 2017

(65) Prior Publication Data

US 2018/0328054 A1 Nov. 15, 2018

(30) Foreign Application Priority Data

Nov. 26, 2015 (GB) ..... 1520909

(51) Int. Cl.
*E04G 21/32* (2006.01)
*E04G 5/04* (2006.01)
*E04G 5/14* (2006.01)

(52) U.S. Cl.
CPC ..... *E04G 21/3223* (2013.01); *E04G 5/041* (2013.01); *E04G 5/045* (2013.01); *E04G 5/14* (2013.01); *E04G 21/3204* (2013.01)

(58) Field of Classification Search
CPC ..... E04G 5/041; E04G 5/045; E04G 5/14; E04G 21/3223; E04G 21/3204; E04G 21/3228; E04G 21/3242
See application file for complete search history.

(56) References Cited

U.S. PATENT DOCUMENTS 3,901,481 A * 8/1975 Probst ..... E04G 21/3214 248/237
3,920,221 A 11/1975 Berry et al.
(Continued)

FOREIGN PATENT DOCUMENTS

AU 31704/95 2/1996
AU 2003257925 5/2004
(Continued)

OTHER PUBLICATIONS

European Examination Report for corresponding European Application No. 16 804 889.0 dated Nov. 18, 2020, 5 pages.
(Continued)

*Primary Examiner* — Colleen M Chavchavadze
(74) *Attorney, Agent, or Firm* — Seyfarth Shaw LLP

(57) ABSTRACT

There is provided a railing post adaptor for a roof support apparatus. The roof support apparatus comprises an elongate member having a plurality of longitudinal sides. The railing post adaptor comprises a roof support apparatus connector for securing the railing post adaptor to the roof support apparatus. The roof support apparatus connector comprises a first connection portion arranged to engage, in use, with a first set of the plurality of longitudinal sides, and a second connection portion, movably mounted to the first connection portion and arranged to engage, in use, with a second set of the plurality of longitudinal sides, the second set being different from the first set. The roof support apparatus connector further comprises a railing connection portion extending from the roof support apparatus connector for
(Continued)

detachably securing a proximal end of a railing post to the roof support apparatus via the railing post adaptor. The first set and the second set each comprise at least two longitudinal sides. The first connection portion and the second connection portion are together configured to substantially prevent rotation of the railing post adapter about a longitudinal axis of the elongate member by engagement with the first set and second set of longitudinal sides.

19 Claims, 6 Drawing Sheets

(56) References Cited

U.S. PATENT DOCUMENTS

| | | | | |
|---|---|---|---|---|
| 4,718,624 | A * | 1/1988 | Greulich | H04R 1/08 248/291.1 |
| 5,249,769 | A * | 10/1993 | Griek | E04G 5/045 248/231.51 |
| 5,379,859 | A * | 1/1995 | Pigman | E04G 3/26 248/237 |
| 5,419,090 | A | 5/1995 | Sandow | |
| 6,006,862 | A * | 12/1999 | Palmer | E04G 5/14 182/113 |
| 6,039,150 | A * | 3/2000 | Palmer | E04G 21/3223 182/113 |
| 6,053,281 | A * | 4/2000 | Murray | E04G 21/3223 248/237 |
| 6,336,623 | B1 * | 1/2002 | McCarthy | E04G 21/3214 256/64 |
| 7,028,990 | B2 * | 4/2006 | Shorey | E04G 5/041 256/19 |
| 8,684,137 | B2 * | 4/2014 | Collister | E04G 5/041 248/237 |
| 2009/0107060 | A1 | 4/2009 | Ellis et al. | |
| 2012/0267594 | A1 * | 10/2012 | Fontaine | E04G 3/265 256/65.01 |

FOREIGN PATENT DOCUMENTS

| | | |
|---|---|---|
| AU | 2006202544 | 1/2008 |
| AU | 2008200877 | 9/2009 |
| DE | 10127641 | 12/2002 |
| FR | 2217975 | 6/1974 |
| FR | 3029550 | 10/2016 |
| GB | 2274664 | 8/1994 |
| GB | 2339824 | 2/2000 |
| GB | 2354790 | 4/2001 |
| GB | 2528876 | 2/2016 |
| NL | 1024827 | 6/2007 |
| NZ | 545699 | 4/2009 |
| WO | 02092946 A1 | 11/2002 |

OTHER PUBLICATIONS

Combined Search and Examination Report for Application No. GB1520909.1 dated Mar. 15, 2016, 7 pages.

Combined Search and Examination Report for Application No. GB1617039.1 dated Mar. 9, 2017, 8 pages.

PCT International Search Report and Written Opinion for Application No. PCT/GB2016/053724 dated Feb. 16, 2017, 13 pages.

* cited by examiner

SUPPORT APPARATUS

CROSS REFERENCE TO RELATED APPLICATIONS

This is a National Stage application of PCT/GB2016/053724, filed Nov. 28, 2016, which claims priority to United Kingdom Patent Application No. 1617039.1, filed Oct. 7, 2016, and United Kingdom Patent Application No. 1520909.1, dated Nov. 26, 2015, the disclosures of which are incorporated herein by reference.

This invention relates to support apparatus for a roof, in particular for a fragile roof.

BACKGROUND

In many locations around the world, some buildings are built having a roof formed from corrugated roof sheets. The roof is typically a pitched roof. Many of these corrugated roofs are fragile and formed from concrete-fibre corrugated roof sheets which can deteriorate over time. The corrugated roof sheets are fixed to purlins which run longitudinally along the roof pitch of the building. The troughs in the corrugated roof sheets are arranged to run transverse to the direction of the purlins. The roof also typically comprises rafters which run transverse to the direction of the purlins and support the purlins in the roof structure. Therefore, a single trough in a corrugated roof sheet will be fixed to several purlins. However, the corrugated roof panels themselves are not designed to support the weight of a person and falls onto a roof panel can cause the roof panel to fail, sending the person and broken parts of the roof panel down through the roof. The typical spacing between adjacent purlins is greater than would be necessary to provide a safety structure to prevent a person falling through the roof. Falls from height can be fatal.

It is known to use a trellis mat resting on spars to prevent falls through fragile concrete-fibre roofs. FIG. 1 shows a roof support system of the prior art. A corrugated roof comprises a plurality of purlins 102 having affixed thereto a corrugated roof sheet 104. The corrugated roof sheet 104 is undulated in a direction parallel to the roof purlins 102 such that each trough 105 of the corrugated roof sheet 104 runs transverse to the roof purlins 102 and crosses multiple purlins 102. A height of the undulations forming the troughs 105 is typically from 35 millimetres to 100 millimetres, though most corrugated roofs have an undulation height of 60-70 millimetres. The troughs 105 typically run up a slope of the roof where the roof is pitched to allow rainwater to run off the roof down the troughs 105. The roof support system comprises a plurality of spars 106 which must be installed in a plurality of the troughs 105. The spars 106 are typically not installed into every trough 105 as this is not necessary. The spars 106 have a height such that the spars 106 extend above an uppermost point of the peaks between troughs 105. The spars 106 have a length exceeding the spacing between purlins 102 and are each supported by a plurality of purlins 102. A trellis mat 108 rests directly on the spars 106. The trellis mat 108 is not designed to be a work platform. If an operative falls in the direction of the corrugated roof sheet 104 from a safe work platform (for example a valley between two corrugated roof sections), the trellis mat 108 transfers the weight of the operative to the roof purlins 102 through the spars 106. The fragile corrugated roof sheet 104 is not relied on to provide any of the bracing force against the fall. In this way, the roof support system prevents falls through roofs. To set up the system on a corrugated roof, an operative must first carry all the required spars 106 and trellis mats 108 onto the roof. The operative must then place a spar 106 at regular intervals along the roof. If the spars 106 are placed too far apart, then the trellis mat 108 may fail when a person falls onto the trellis mat 108. If the spars 106 are placed too closely together, then additional spars 106 will be required and the roof support system can take longer to assemble and disassemble. Furthermore, the spars 106 must be positioned carefully to ensure that they stay upright in the trough 105. If the spars 106 fall over, the weight of a person on the roof support system may cause the fragile roof panel to break, sending debris falling from the roof, even though the person would be prevented from falling. It will be appreciated that it is possible to set the systems up incorrectly without proper training because it is possible to space the spars 106 at a separation distance which is greater than the minimum safe separation distance.

The present invention provides at least an alternative to solutions of the prior art.

BRIEF SUMMARY OF THE DISCLOSURE

In accordance with an aspect of the present disclosure, there is provided a railing post adaptor for a roof support apparatus. The roof support apparatus comprises an elongate member having a plurality of longitudinal sides. The railing post adaptor comprises: a roof support apparatus connector for securing the railing post adaptor to the roof support apparatus. The roof support apparatus connector comprises: a first connection portion arranged to engage, in use, with a first set of the plurality of longitudinal sides; and a second connection portion, movably mounted to the first connection portion and arranged to engage, in use, with a second set of the plurality of longitudinal sides, the second set being different from the first set. The railing post adaptor further comprises a railing connection portion extending from the roof support apparatus connector for detachably securing a proximal end of a railing post to the roof support apparatus via the railing post adaptor. The first set and the second set each comprise at least two longitudinal sides. The first connection portion and the second connection portion are together configured to substantially prevent rotation of the railing post adapter about a longitudinal axis of the elongate member by engagement with the first set and second set of longitudinal sides.

Thus, a railing post can be attached to a roof support apparatus by means of a temporarily attached railing post adaptor. When the railing posts are not required on the roof support apparatus, the railing post adaptor can also be removed, meaning the roof support apparatus is suitable for a wide range of roofing tasks. For example, a connection component which is permanently attached to the roof support apparatus may present a trip hazard when the roof support apparatus is to be used without railing posts secured thereto. When the railing posts are required, the railing post adaptor can be secured to the roof support apparatus in a safe working location (for example, on the ground), and the roof support apparatus can then be deployed in position with the railing post adaptor already attached thereto. The railing post can be secured to the roof support apparatus via the railing post adaptor once the roof support apparatus is in position. In this way, the safe assembly of a roof support apparatus including a railing can be completed at height by separate transport of the roof support apparatus and the railing onto the roof. Furthermore, it may be difficult to access some parts of the roof support apparatus once it is in place on a roof, and so the installation of the railing post adaptor on the roof support apparatus after the roof support apparatus has been installed in position on a roof may be difficult. For example, access to or around the underside of the roof support apparatus in situ may be difficult.

In use, the elongate member may be located between the first connection portion and the second connection portion. Thus, the first connection portion and the second connection portion are configured to substantially surround the elongate member. In embodiments, the first connection portion and the second connection portion may be configured to substantially clamp the elongate member therebetween.

Although in embodiments, some of the longitudinal sides included in the first set may also be included in the second set, in a preferred embodiment, each of the longitudinal sides included in the first set may not be included in the second set. Thus, the first set may be completely different from the second set.

The railing post adaptor may be arranged to be secured to an elongate member having a predetermined size. In embodiments, the elongate member having a predetermined size may be the only size of elongate member to which the railing post adaptor can be secured. It will be understood that this does not impose any limitation on a size of the railing post which can be secured to the railing post adaptor.

The first connection portion may have defined therein a locating opening. The second connection portion may comprise a locating protrusion sized to fit within the locating opening. When the locating protrusion is within the locating opening, the first connection portion may be substantially fixed relative to the second connection portion in any direction transverse to an axial direction of the locating opening. The locating protrusion may extend from the second connection portion by only a thickness of the first connection portion at the locating opening. The locating protrusion may be sized to fit substantially exactly within the locating opening.

The first connection portion may have defined therein an elongate slot. The second connection portion may comprise a protrusion sized to fit within the elongate slot. When the protrusion is within the elongate slot, the first connection portion may be slidably mounted to the second connection portion, whereby to vary a spacing between a first connection surface of the first connection portion and a second connection surface of the second connection portion. The first connection surface and the second connection surface may be for engagement with a respective one of the first set and the second set of longitudinal sides. The protrusion sized to fit within the elongate slot may extend away from the second connection portion beyond a thickness of the first connection portion at the elongate slot. The protrusion sized to fit within the elongate slot may be substantially cylindrical. The elongate slot may have a length of at least 20 millimetres. The elongate slot may have a length at least 5 times a diameter of the protrusion sized to fit within the elongate slot.

The protrusion may be a threaded protrusion. The railing post adaptor may further comprise a threaded fastener having internal threads for engagement with the threaded protrusion to secure the first connection portion to the second connection portion. The threaded fastener may be a wing-not or any other suitable fastener.

It will be understood that the elongate slot and the protrusion sized to fit within the elongate slot may alternatively be positioned on the second connection portion and the first connection portion respectively. Similarly, the location opening and the locating protrusion may alternatively be positioned on the second connection portion and the first connection portion respectively.

The elongate member may have a substantially rectangular cross-section in a direction transverse to the longitudinal direction. Thus, the elongate member may be any standard box section conventionally used for roof support apparatus.

The first connection portion and the second connection portion may each be formed from sheet metal. It will be understood that alternative materials may be used.

The first connection portion may extend around only a part of a one of the longitudinal sides of the first set, in a direction transverse to the longitudinal direction of the elongate member. In an embodiment, the first connection portion may extend around less than half of the one of the longitudinal sides of the first set. Thus, the roof support apparatus connector can be easily secured to the elongate member without requiring full separation of the first connection portion from the second connection portion.

The second connection portion may not engage with the one of the longitudinal sides of the first set. Thus, the securement of the roof support apparatus connector to the elongate member may be even easier.

The railing connection portion may extend from the first connection portion. The railing connection portion may be connected to the first connection portion by a welded connection. It will be understood that the railing connection portion may instead extend from the second connection portion.

The railing connection portion may be for detachably securing the proximal end of the railing post to the roof support apparatus such that a longitudinal axis of the railing post is offset in a direction transverse to the longitudinal axis of the elongate member. Thus, the railing post is positioned off-centre from the elongate member. In embodiments, the railing post adaptor is configured to be reversible whereby the railing post can be detachably secured on either side of the longitudinal axis of the elongate member, in use.

The railing connection portion may comprise a first side wall extending away from the roof support apparatus connector and a second side wall, spaced from the first side wall, and extending away from the roof support apparatus connector. The first side wall and the second side wall may be configured for detachably securing the proximal end of the railing post therebetween.

The first side wall and the second side wall may extend substantially transverse to the longitudinal axis of the elongate member. Thus, the railing post can be prevented from rotation about an axis substantially transverse to the longitudinal axis of the elongate member by the first side wall and the second side wall. Further, the railing post may be easily secured between the first side wall and the second side wall by an operator standing on the roof support apparatus.

The first side wall and the second side wall may each have defined therein an elongate slot, open to a boundary of the respective first side wall and the second side wall. The elongate slots may be for engagement by locating members extending transversely from the railing post. Thus, the railing post can be easily secured between the first side wall and the second side wall and rotationally fixed.

At least one of the first side wall and the second side wall may have defined therein a mutually spaced plurality of further locating holes, spaced from the elongate slot, for engagement with a connection member of the railing post, whereby to vary a pitch of the railing post relative to the roof support apparatus connector. Thus, the pitch of the railing post can be easily adjusted by selective engagement between the railing post and a one of the further locating holes.

The railing post may further comprise a bracing leg. Thus, the railing post can be prevented from rotating about an axis transverse to a longitudinal direction of the railing post by the bracing leg. Even when the roof support apparatus is not arranged to resist rotation about the axis transverse to the longitudinal direction of the railing post, the railing post may still resist rotation about the axis transverse to the longitudinal direction of the railing post due to the bracing leg. The bracing leg may be pivotably connected at a proximal end thereof to the proximal end of the railing post. Thus, the bracing leg can rotate into a deployed configuration and brace the railing post against a roof surface or a further member of the roof support apparatus.

At least one of the first side wall and the second side wall may have defined therein a leg support opening for engagement with a connection member of the bracing leg, whereby to secure the bracing leg at a predetermined angle relative to the railing post. In one embodiment, the predetermined angle is substantially 90 degrees.

The railing post adaptor may further comprise the railing post.

The railing post may comprise at least one barrier connection member for connecting the railing post to a barrier member spanning adjacent railing posts connected to the roof support apparatus. Thus, multiple railing posts may be connected together via one or more barrier members. The barrier member may be a railing pole configured to be arranged substantially parallel to a roof in use. The barrier member may be a railing pole configured to be arranged substantially transvers to the railing post in use. The railing pole may be telescopically extendable.

The barrier connection member may be a loop member. The loop member may be arranged to surround a circumference of the railing pole in use, whereby to retain the railing pole against the railing post.

A pivotable foot may be provided at a distal end of the bracing leg. The pivotable foot may be arranged to conform to a surface of the roof, or to a surface of a further member of the roof support apparatus.

The disclosure extends to a kit of parts for a roof support apparatus. The kit of parts comprises: a first elongate member having a first plurality of longitudinal sides; a second elongate member having a second plurality of longitudinal sides; a link member to space the first spar from the second spar such that the first spar and the second spar are mutually parallel; and a railing post adaptor comprising a roof support apparatus connector for securing the railing post adaptor to the first elongate member. The roof support apparatus connector comprises: a first connection portion arranged to engage, in use, with a first set of the first plurality of longitudinal sides; and a second connection portion, movably mounted to the first connection portion and arranged to engage, in use, with a second set of the first plurality of longitudinal sides. The second set is different from the first set. The railing post adaptor further comprises a railing connection portion extending from the roof support apparatus connector for detachably securing a proximal end of a railing post to the roof support apparatus via the railing post adaptor. The kit of parts further comprises the railing post. The first set and the second set each comprise at least two longitudinal sides. The first connection portion and the second connection portion are together configured to substantially prevent rotation of the railing post adapter about a longitudinal axis of the first elongate member by engagement with the first set and second set of longitudinal sides.

In accordance with another aspect of the present disclosure there is provided a support apparatus for a corrugated roof. The support apparatus comprises a first spar and a second spar parallel to the first spar. The support apparatus further comprises at least one connection member extending from the support apparatus in a first direction substantially normal to a plane intersecting the first spar and the second spar. The at least one connection member is configured to connect the support apparatus to a support platform. The support apparatus further comprises a link member connecting the second spar to the first spar and spacing the second spar from the first spar.

Thus, there is provided a support apparatus where the first spar and second spar are linked, whereby to constrain the separation distance between the spars, preventing an operative from inadvertently installing an unsafe roof support. Furthermore, the support apparatus is quick to install because an operative need not measure the separation between troughs in a corrugated roof or carry each spar up to the roof separately. Any reduction in the time spent to set up the safety equipment on the roof decreases the chances of a fall through the roof occurring during setup of the safety equipment.

The support apparatus may be a roof support apparatus as described hereinbefore.

The link member may be movable relative to at least one of the first spar and the second spar whereby to vary the spacing of the second spar from the first spar. Thus, the support apparatus is suitable for use with a range of different corrugated roofs, each having a different spacing between adjacent troughs of the undulating shape of the corrugated roof.

In one embodiment, the link member may pivotably connect the first spar to the second spar. Additionally or alternatively, the link member may extensibly connect the first spar to the second spar.

The link member may have defined therein an elongate slot arranged to engage with a corresponding pin provided on the second spar. Thus, the first spar and the second spar can be moved apart by moving the location of the corresponding pin in the elongate slot. The slot may have a slot length of greater than 50 millimetres. The slot may have a slot length of greater than 100 millimetres. The slot may have a slot length of less than 300 millimetres. The slot may have a slot length of less than 200 millimetres.

The corresponding pin may be the connection member. Thus, the same pin which is used to engage in the elongate slot of the link member may also be used to connect the support apparatus to the support platform.

An end of the link member may be configured to be extensibly fixed relative to the first spar.

The connection member may be a pin. The pin may comprise a first section extending from the support apparatus and having a first diameter and a second section extending from the first section and having a second diameter greater than the first diameter. Thus, the pin can be arranged to retain the support platform on the support apparatus, in use. The pin may have a length extending from the support apparatus of greater than 30 millimetres.

In embodiments, the connection member may be configured to only retain the support platform against translational movement of the support platform in a lateral plane of the support platform. Thus, the support platform can be removed from the support apparatus by lifting, without removal of the connection members. Further, the support platform can be easily installed on the support apparatus without requiring a user to spend a long time in a dangerous position on a fragile roof.

The first spar and the second spar may extend at least partially from the link member in a second direction, opposite the first direction. Thus, the first spar and the second spar are arranged to extend in a trough-wards direction of the corrugated roof, in use, and the link member is arranged to pass over intervening troughs in the corrugated roof, in use. The first spar and the second spar may each have a length in the second direction of greater than 35 millimetres. The first spar and the second spar may each have a length in the second direction of greater than 50 millimetres. The first spar and the second spar may each have a length in the second direction of less than 100 millimetres. The first spar and the second spar may each have a length in the second direction of less than 70 millimetres.

A length of the first spar and the second spar may be longer than a length of the link member. The length of the first spar and the second spar may be greater than 1 metre. The length of the first spar and the second spar may be less than 3 metres. The length of the link member may be greater than 300 millimetres. The length of the link member may be less than 90 centimetres.

The support apparatus may comprise a plurality of link members. The support apparatus may comprise at least two link members. The support apparatus may comprise exactly two link members.

Each of the first spar and the second spar may have extending therefrom at least one connection member. Each of the first spar and the second spar may have extending therefrom at least two connection members. The support apparatus may comprise exactly four connection members.

The connection members may be connected to the link members. Thus, the link members are connected to the spars by the same components which are configured to connect the support platform to the support apparatus.

At least one of the first spar and the second spar may comprise a joining member configured to join the support apparatus to a further support apparatus.

The joining member may be a sleeve member arranged to fit over an end of the first spar or the second spar.

The support apparatus may further comprise a support platform configurable to be connected to the support apparatus by the connection member.

The support platform may be a trellis mat.

BRIEF DESCRIPTION OF THE DRAWINGS

Embodiments of the invention are further described hereinafter with reference to the accompanying drawings, in which.

DETAILED DESCRIPTION

Figure 1:
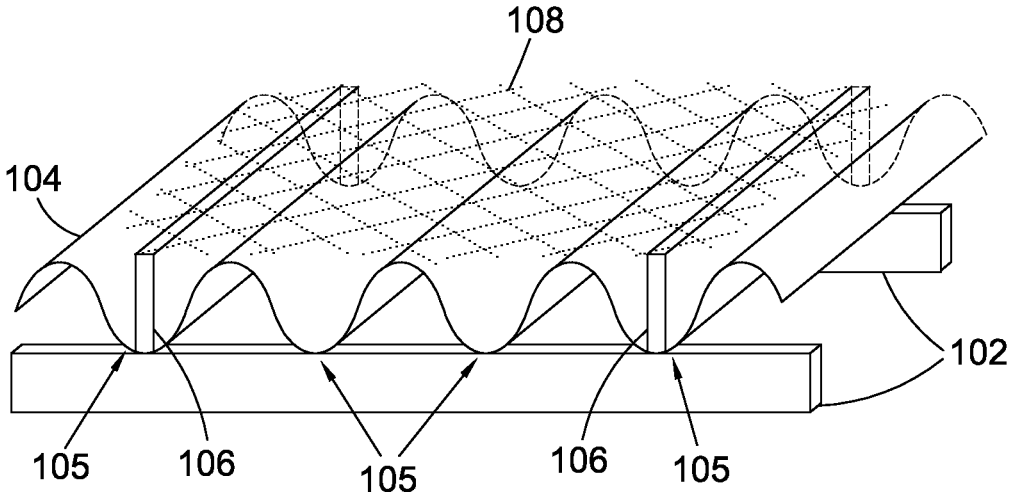
FIG. 1 shows a roof support system of the prior art for use with fragile roofs.
Figure 2:
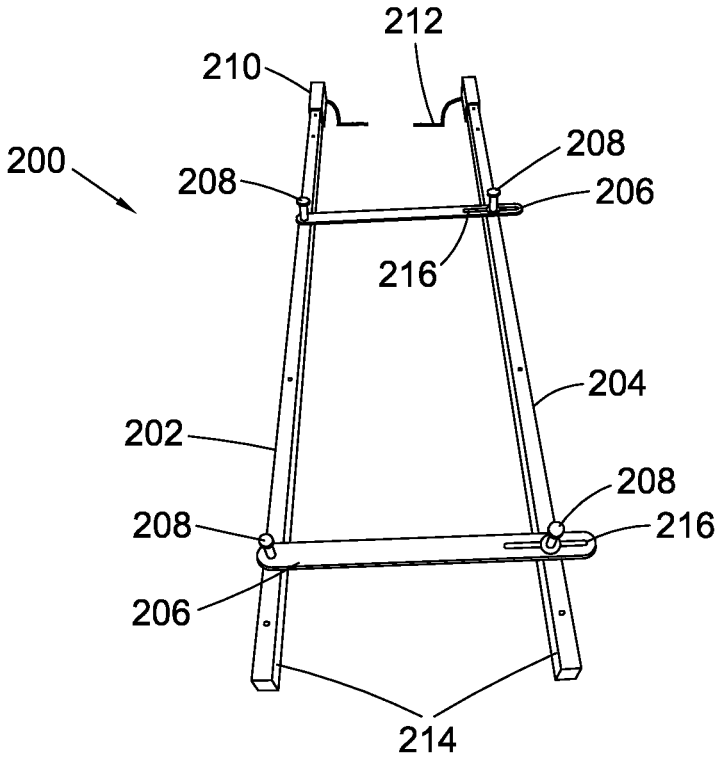
FIG. 2 shows a support apparatus in accordance with an embodiment of the present invention.

FIG. 2 shows a support apparatus in accordance with an embodiment of the present invention. The support apparatus comprises a support structure 200 comprising a first spar 202 and a second spar 204. The first spar 202 and the second spar 204 are each elongate members formed from metal box section having a substantially rectangular cross-section with a longest side of the rectangular cross-section being arranged to be in a substantially vertical orientation when the support structure is deployed on a corrugated roof. The first spar 202 and the second spar 204 each have a length of approximately 1.90 metres. The second spar 204 is parallel to the first spar 202 and spaced from the first spar 202. The first spar 202 is connected to the second spar 204 by two link members 206. The link members 206 are formed from metal plate, and connect to the spars 202, 204 adjacent to a top surface of the spars 202, 204. Each of the first spar 202 and the second spar 204 has extending therefrom two connection members 208. The connection members 208 connect the link members 206 to the top surface of the spars 202, 204. The connection members 208 are pins comprising a first portion extending from the link members 206 having a first diameter and a second portion extending from the first portion having a second diameter greater than the first diameter. The link members 206 have defined therein an elongate slot 216 at an end adjacent to the second spar 204. The link members 206 connect to the second spar 204 using the connection member 208 through the slot 216. In this way, the distance from the first spar 202 to the second spar 204 can be varied by moving the connection member 208 within the slot 216. The distance from the first spar 202 to the second spar 204 is fixed by tightening the connection member 208 against an upper surface surrounding the slot 216 whereby to clamp the second spar 204 in position against the link member 206. In this particular embodiment, the connection member 208 is threaded and is tightened against the upper surface by screwing into a correspondingly threaded hole defined in an upper surface of the second spar 204. It will be appreciated that in some embodiments, the distance from the first spar 202 to the second spar 204 need not be fixed such that the second spar 204 is free to slide relative to the link member 206. Each of the first spar 202 and the second spar 204 further comprises a joining member 210 provided at an end of the spars 202, 204. The joining member 210 is a sleeve arranged to fit over an opposite end of a further support structure. The joining members 210 are provided with a drop-nose pin 212 flexibly connected to the joining member 210 and configurable to engage with a hole 214 defined in an opposite end of the spars 202, 204 of a further support structure as will be described further in relation to FIG. 3 below.

FIG. 2 shows the support structure 200 in a deployed arrangement. For ease of transport, in this embodiment, the support structure 200 is movable to a compact arrangement. In the compact arrangement, the second spar 204 lies flat against the first spar 202 by pivotable movement of the link members 206 about pivot points formed at the connection members 208.

In some embodiments, the first spar 202 and the second spar 204 have defined on the top surface a plurality of holes whereby the connection members 208 may be repositioned. In such cases, the link members 206 would also change position with the connection member 208.

In some embodiments, the first spar 202 and the second spar 204 have defined on each side surface a plurality of joining holes whereby the support structure 200 may be connected to a further support structure. An inner surface of a spar on one of the support structure or the further support structure is provided against an outer surface of a spar on the other of the support structure or the further support structure. A bolt or other fastener is used to fix the support structure to the further support structure, whereby to provide a combined support structure having a length greater than the length of a single support structure but less than twice the length of the support structure.

Figure 3:
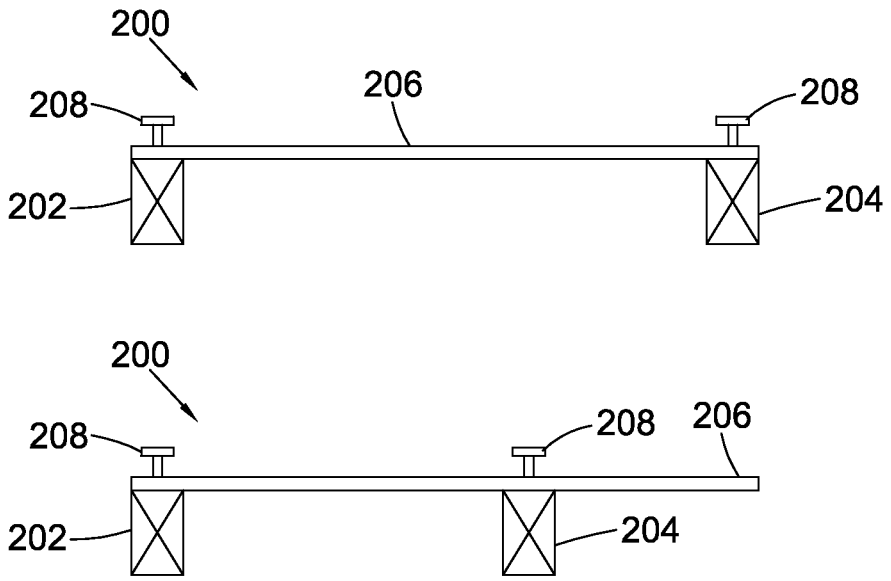
FIG. 3 shows a schematic of a support apparatus in accordance with an embodiment of the present invention.

FIG. 3 shows a schematic of a support apparatus in accordance with an embodiment of the present invention. The support structure 200 described with reference to FIG. 2 is illustrated schematically from an end-on perspective. An upper diagram in FIG. 3 shows the support structure 200 where the second spar 204 is provided at the maximum extent of the slot 216 (not shown). In this arrangement, the spacing between the centre-points of the connection members 208 is 602 millimetres. A lower diagram in FIG. 3 shows the support structure 200 where the second spar 204 is provided at the minimum extent of the slot 216. In this arrangement, the spacing between the centre-points of the connection members 208 is 452 millimetres. This flexibility allows the support apparatus to be used with a wide variety of corrugated roofs having different spacing between adjacent troughs and still ensure that the spars 202, 204 are both capable of being positioned in the base of respective troughs.

In the illustrated embodiments, the spars 202, 204 have a cross-sectional height of approximately 62 millimetres and a cross-sectional width of approximately 38 millimetres. The link members 206 have a thickness of 6 millimetres. The connection members 208 extend above the link members by a distance of approximately 50 millimetres.

Figure 4:
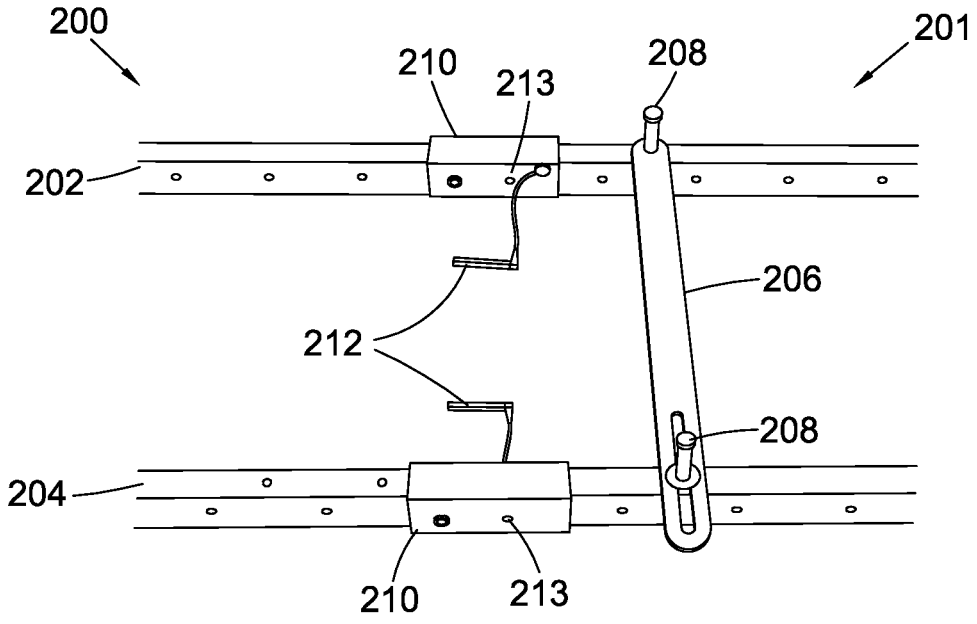
FIG. 4 shows two support apparatus modules joined together in accordance with an embodiment of the invention.

FIG. 4 shows two support apparatus modules joined together in accordance with an embodiment of the invention. To join a support structure 200 to a further support structure 201, an end of the support structure 201 where the spars 202, 204 do not comprise the joining member 210 is inserted into the joining member 210 of the support structure 200, such that holes in the joining member 210 of the support structure 200 align with holes in the spars 202, 204 of the further support structure. The drop-nose pin 212 for each spar is inserted through the holes in each respective spar, and the nose is "dropped" to secure the drop-nose pin 212 in place and to prevent inadvertent separation of the support structure 200 from the further support structure 201.

Figure 5:
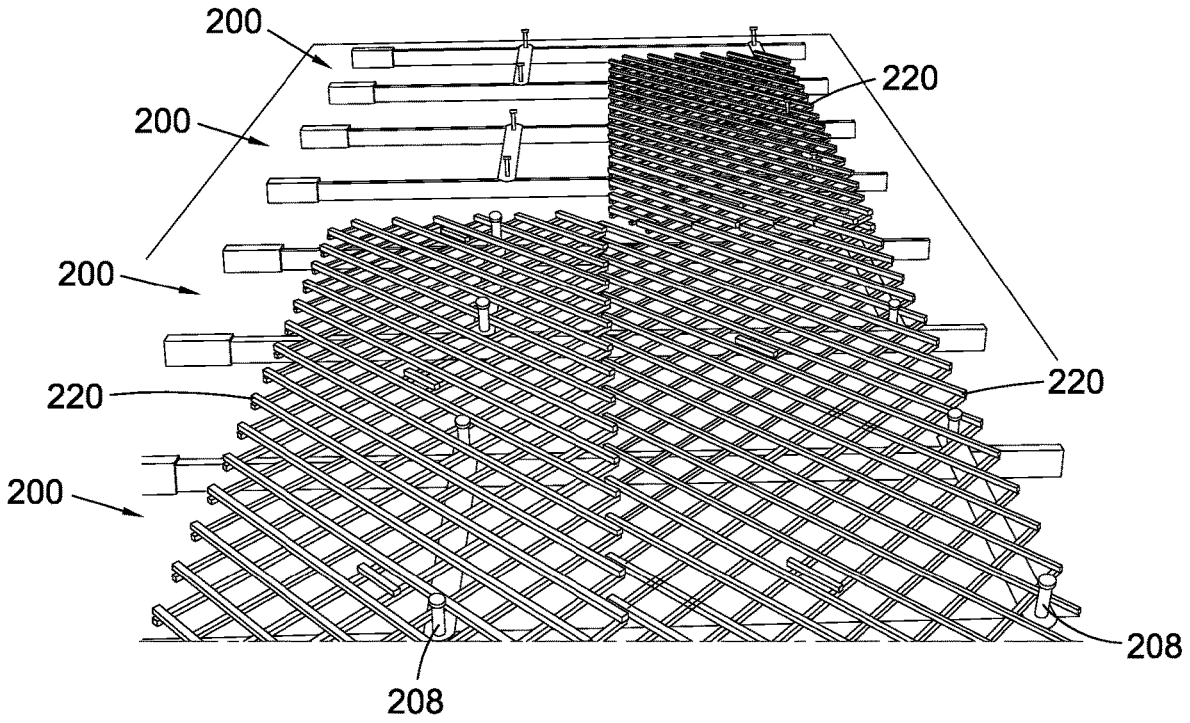
FIG. 5 shows a support apparatus with a trellis mat in place on the support apparatus, in accordance with an embodiment of the invention.

FIG. 5 shows a support apparatus with a trellis mat in place on the support apparatus, in accordance with an embodiment of the invention. A trellis mat 220 comprises a first array of parallel tubular members and a second array of parallel tubular members, each of the second array of parallel tubular members being pivotably connected to a plurality of the first array of parallel tubular members whereby to form a trellis. The trellis mat 220 is positioned on the support structure 200 to provide a fall prevention apparatus for a fragile roof. It will be appreciated that a single trellis mat 220 can be configured to provide a safety platform in a range of different shapes and sizes. The connection members 208 are arranged to engage with the trellis mat 220 by passing through holes defined by the structure of the trellis mat 220. In this way, the trellis mat 220 is held in position on the support structure 200. Adjacent trellis mats 220 can be configured to interlock as necessary to provide a larger safety platform.

To assemble the support apparatus, both the trellis mat 220 and the support structure 200 are configurable to be transported to the roof in a compact arrangement in which each is easy to handle. On the roof, a first support structure 200 is moved into the deployed arrangement and positioned such that each spar 202, 204 sits at the base of a respective parallel trough on the corrugated roof. An operative need not measure or even know about minimum spacing between the spars 202, 204 because it is impossible to space the first spar 202 and the second spar 204 a greater distance apart than the length of the link members 206. Once the first support structure 200 is placed in position, a trellis mat 220 is positioned on the support structure 200. If a larger support apparatus is required in a direction transverse to the direction of each trough, a further support structure 200 is positioned adjacent the first support structure 200 and spaced by the same distance as the distance between the first spar 202 and the second spar 204. This can easily be achieved by an operative by counting the number of empty troughs between the first spar 202 and the second spar 204 and ensuring that the further support structure also leaves the same number of empty troughs in the corrugated roof beyond the first support structure. Similarly, if a larger support apparatus is required in a direction along the roof troughs (for example beside a walkway up the pitch of a roof), multiple support structures can be linked together using the joining members as described previously.

Figure 6:
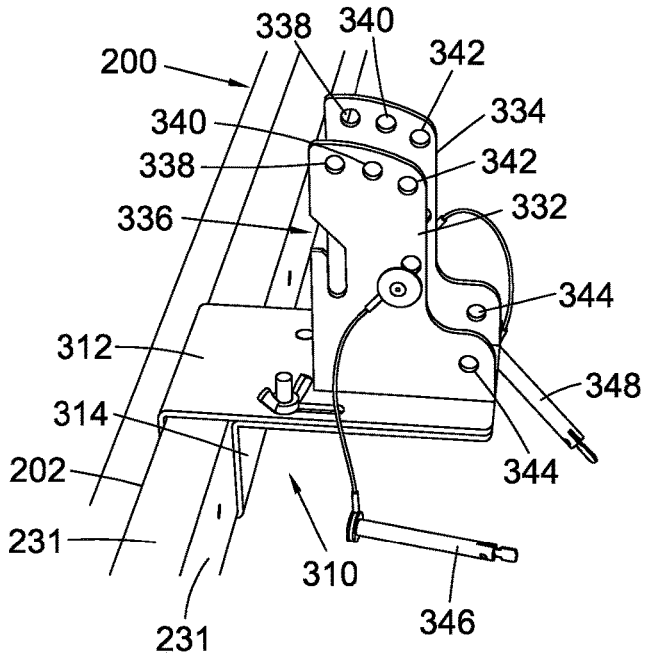
FIG. 6 shows a railing post adaptor secured to the support apparatus shown in any of FIGS. 1 to 5.
Figure 7:
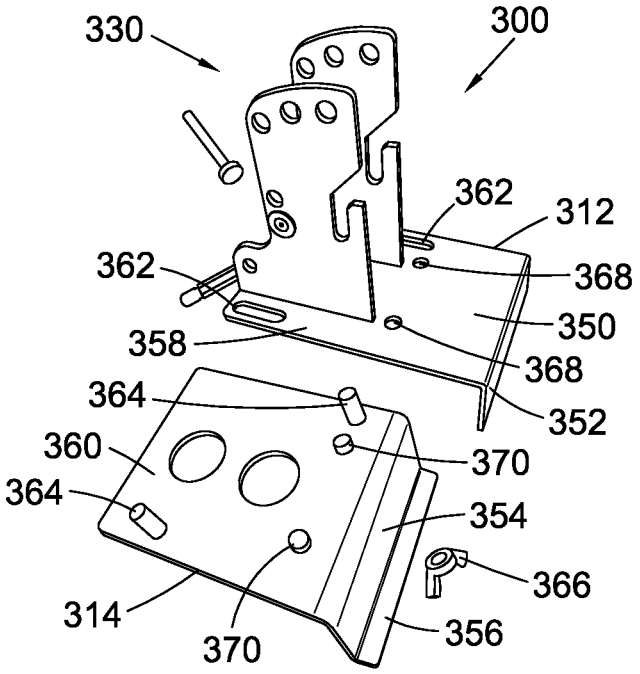
FIG. 7 shows a disassembled view of the railing post adaptor shown in FIG. 6.

FIG. 6 shows a railing post adaptor secured to the support apparatus shown in any of FIGS. 1 to 5. The elongate member in the form of a first spar 202 of the roof support apparatus 200 has a railing post adaptor 300 secured thereto. In this example, the railing post adaptor 300 is clamped tight to the first spar 202 such that the railing post adaptor 300 is substantially prevented from sliding in a longitudinal direction of the first spar 202. The railing post adaptor is for facilitating securement of a railing post to the support apparatus 200 where no connection means exist on either the railing post or the support apparatus for directly connecting the railing post to the support apparatus. The railing post adaptor 300 comprises a roof support apparatus connector 310 for securing the railing post adaptor 300 to the support apparatus 200. The roof support apparatus connector 310 comprises a first connection portion 312 and a second connection portion 314. In this example, as will be described more fully with reference to FIG. 7 hereinafter, the first connection portion 312 is a separate component to the second connection portion 314. In alternative examples, the first connection portion 312 could be hingedly connected to the second connection portion 314 in the same component of the roof support apparatus connector 310. In this example, the second connection portion 314 is slidably mounted to the first connection portion 312 such that the first connection portion 312 can be variably spaced from the second connection portion 314 whereby to selectively engage with longitudinal sides 231 of the first spar 202. The first connection portion 312 is shaped to engage with a first set of two adjacent longitudinal sides 231 of the first spar 202. The second connection portion 314 is shaped to engage with a second set of two adjacent longitudinal sides 231 of the first spar 202. In this example, the first set and the second set are completely different; the first set corresponding to the upper and left-hand longitudinal sides 231 and the second set corresponding to the lower and right-hand longitudinal sides 231, when viewed in the orientation of FIG. 6. It will be understood that in some examples, the first connection portion 312 and the second connection portion 314 may each engage with at least some of the same longitudinal sides 231. With reference to FIG. 7, which shows a disassembled view of the railing post adaptor 300 shown in FIG. 6, the first connection portion 312 comprises a first side portion 350 for engaging with an upper longitudinal side 231 of the first spar 202 and a second side portion 352 extending substantially transversely from a distal end of the first side portion 350. The first side portion 350 has a proximal end away from the second side portion 352. The second side portion 352 is for engaging with an outer longitudinal side 231 of the first spar 202. In this way, the first connection portion 312 engages both the upper longitudinal side 231 and the outer longitudinal side 231 of the first spar 202. The second connection portion 314 comprises a third side portion 354 for engaging with a further outer longitudinal side 231 of the first spar 202, and a fourth side portion 356 extending substantially transversely from a distal end of the third side portion 354. The third side portion 354 comprises a proximal end away from the distal end thereof and extends in a direction substantially transverse to the first side portion 350. The fourth side portion 356 is for engaging with a lower longitudinal side 231 of the first spar 202. In this way, the second connection portion 314 engages both the further outer longitudinal side 231 and the lower longitudinal side 231 of the first spar 202. In this example, the fourth side portion 356 is arranged to extend over only a part of the lower longitudinal side 231 of the first spar 202. Together, the first connection portion 312 and the second connection portion 314 engage all four longitudinal sides 231 of the first spar 202. The first connection portion 312 comprises a first facing portion 358 and the second connection portion 314 comprises a second facing portion 360. The first facing portion 358 and the second facing portion 360 are arranged to be mutually facing. The first side portion 350 extends substantially parallel from an end of the first facing portion 358. The third side portion 354 extends substantially transversely from an end of the second facing portion 360. By sliding the first facing portion 358 relative to the second facing portion 360, a spacing between the second side portion 352 and the third side portion 354 can be varied. In this example, the first facing portion 358 has defined therein two elongate slots 362 for sliding engagement by two threaded connection members in the form of two threaded protrusions 364 provided on a facing surface of the second facing portion 360. The elongate slots 362 define an extent of a sliding movement between the second side portion 352 and the third side portion 354. The threaded protrusions 364 are engageable by threaded fasteners having an internal threaded portion in the form of a wingnut 366 to secure the first facing portion 358 of the first connection portion 312 against the second facing portion 360 of the second connection portion 314.

In this example, the first facing portion 358 has further defined therein two circular locating openings 368 for engagement with two circular locating protrustions 370 provided on the facing surface of the second facing portion 360. The locating protrusions 370 extend only a thickness of the first facing portion 358, whereby to sit substantially flush with the first facing portion 358 when located within the locating openings 368.

Returning to FIG. 6, the railing post adaptor 300 further comprises a railing connection portion 330. As will be explained with reference to FIG. 9 below, the railing connection portion 330 is for detachably securing a proximal end of a railing post to the roof support apparatus 200 via the railing post adaptor 300. In this example, the railing connection portion 330 extends directly from the roof support apparatus connector 310 and in particular extends from the first facing portion 358 of the first connection portion 312. The railing connection portion 330 comprises a first side wall 332 and a second side wall 334. The first side wall 332 and the second side wall 334 are substantially similar and are spaced whereby to define a space therebetween for receiving the proximal end of the railing post. Each of the first side wall 332 and the second side wall 334 extends in a direction substantially normal to the first facing portion 358 and has defined therein an elongate slot 336. The elongate slot 336 is open to a boundary of the respective side walls 332, 334. The elongate slot 336 extends substantially towards the roof support apparatus connector 310. Each of the first side wall 332 and the second side wall 334 also has defined therein a mutually spaced plurality of further locating holes 338, 340, 342. In this example, the mutually spaced plurality of further locating holes 338, 340, 342 is first further locating hole 338, a second further locating hole 340 and a third further locating hole 342, each spaced circumferentially at a first radial distance from a lower portion of the elongate slot 336, as will be described more fully in relation to FIG. 10 hereinafter. Each of the first and second side walls 332, 334 has further defined therein leg locating holes 344 as will be described more fully in relation to FIG. 9 hereinafter. The railing post adaptor 300 also has flexibly secured thereto a first drop-nose pin connector 346 and a second drop-nose pin connector 348. The first drop-nose pin connector 346 is for engagement with a one of the further locating holes 338, 340, 342 in each of the first side wall 332 and the second side wall 334 when a railing post is inserted therebetween in order to secure the railing post in a predetermined position as will be described further with reference to FIGS. 9 and 10 hereinafter. The second drop-nose pin connector 348 is for engagement with the leg locating holes 344 in each of the first side wall 332 and the second side wall 334 for securing a bracing leg of the railing post as will be described further in relation to FIGS. 8 and 9 hereinafter.

In this example, the railing post adaptor is formed substantially from sheet metal, in particular sheet steel, but it will be appreciated that alternative materials may be used.

Figure 8:
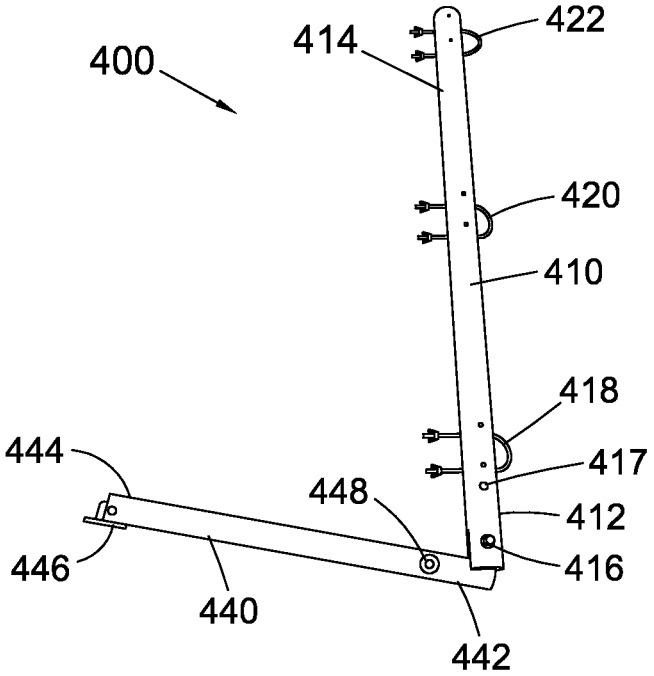
FIG. 8 shows a railing post for securing to the railing post adaptor shown in FIG. 6.

FIG. 8 shows a railing post for securing to the railing post adaptor shown in FIG. 6. The railing post 400 is for insertion into the railing connection portion 330. The railing post 400 comprises an elongate member 410 providing an upright portion of the railing post 400 and a support leg 440. In this example, the elongate member 410 is substantially cylindrical and has a length of approximately 1 metre. The elongate member 410 has a proximal end 412 and a distal end 414. A protuberance 416 is provided at the proximal end 412 of the elongate member 410. The protuberance 416 extends from the elongate member 410 in a direction substantially transverse to a longitudinal axis of the elongate member 410. A securing hole 417 is defined in the elongate member 410 spaced from the protuberance 416 in a direction towards the distal end 414 of the elongate member 410. In use, the protuberance 416 is engaged within the elongate slot 336 defined within the railing connection portion 330. Once the protuberance 416 is fully inserted within the elongate slot 336, the securing hole 417 in the elongate member 410 is aligned with a one of the further locating holes 338, 340, 342 in the side walls 332, 334, whereby to position the elongate member 410 of the railing post 400 at a predefined pitch angle relative to the roof support apparatus connector 310. The first drop-nose pin 346 is engaged through the securing hole 417 and the one of the further locating holes 338, 340 342. In this example, the first locating hole 338 is used to provide a railing post 400 which extends substantially normally from the roof support apparatus 200. The second locating hole 340 and the third locating hole 342 can alternatively be used to provide a railing post 400 which makes an acute angle with the roof surface on which the roof support apparatus 200 rests. Typically, in use, the railing post 400 will always be arranged to extend substantially upright as will be understood with reference to FIG. 10 below. Although the securing hole 417, the further locating holes 338, 340, 342 and the first drop-nose pin 346 are described as being used to secure the railing post 400 in position on the railing post adaptor 300, it will be understood that alternative connection means could be used, such a spring loaded pins extending from the railing post 400, a nut and bolt replacing the first drop-nose pin 346. In the case of a nut and bolt, the further locating holes 338, 340, 342 could be in the form of an arcuate slot, with the nut and bolt providing a frictional securement to hold the railing post 400 in position.

The elongate member 410 comprises a connection member for connecting the railing post 400 to further railing posts or other safety barrier members. In this example, the connection member is in the form of three hoop members 418, 420, 422. A first hoop member 418 is provided at the proximal end 412 of the elongate member 410. A second hoop member 422 is provided at the distal end 414 of the elongate member 410. A third hoop member 420 is provided between the first hoop member 418 and the second hoop member 422. Each of the hoop members 418, 420, 422 is adjustable such that a horizontal railing pole (not shown) can be secured to the elongate member 410 in the region of each of the respective hoop members 418, 420, 422. In this way, the hoop members 418, 420, 422 can be used to attach the railing post 400 to further railing posts via horizontal railing poles. The horizontal railing poles will be described more fully in relation to FIG. 10 hereinafter. In an alternative example, the connection member for connecting the railing post 400 to further railing posts or other safety barrier members may be a hook member onto which safety barriers can be releasably connected.

The railing post 400 further comprises a support leg 440. The support leg is pivotably connected to the proximal end of the elongate member 410. In this example, the support leg 440 is pivotably connected about a pivot axis which runs through the protuberance 416. The support leg 440 comprises a proximal end 442 at which the support leg 440 is pivotably connected to the elongate member 410 and a distal end 444 provided with a foot 446 for supporting the support leg 440 on a surface, such as a roof surface. In this example, the foot 446 is pivotably connected to the distal end 444 of the support leg 440. In this way, the foot 446 can pivot to conform to the contour of a roof and to support the support leg 440 on substantially any angle of underlying surface, for example any part of the undulations on a corrugated roof. The proximal end 442 of the support leg 440 also has defined therein a securing opening 448. In use, the support leg 440 is pivotably rotated away from the elongate member 410 to an angle of approximately 90 degrees (depending on the pitch chosen for the elongate member 410 relative to the roof support apparatus). The securing opening 448 is aligned with the corresponding leg locating holes 344 in the first and second side walls 332, 334. The second drop-nose pin 348 is used to secure the support leg 440 in position in the railing post adaptor 300. In a similar way to that for the first drop-nose pin 346 discussed previously, although the securing opening 448, the leg locating holes 344 and the second drop-nose pin 348 are described as being used to secure the support leg 440 in position on the railing post adaptor 300, it will be understood that alternative connection means could be used, such a spring loaded pins extending from the support leg 440, a nut and bolt replacing the second drop-nose pin 348, or any other suitable alternative. Any openings need not be circular, and other shapes of opening and fastener can be used (for example square, or rectangular.

Although the support leg 440 is described as being pivotably connected to the elongate member 410, it will be appreciated that the support leg 440 may instead be provided as a separate component to connect separately to the railing post adaptor 300. In this case, further connection points between the support leg 440 and the railing post adaptor 300 may be required.

Figure 9:
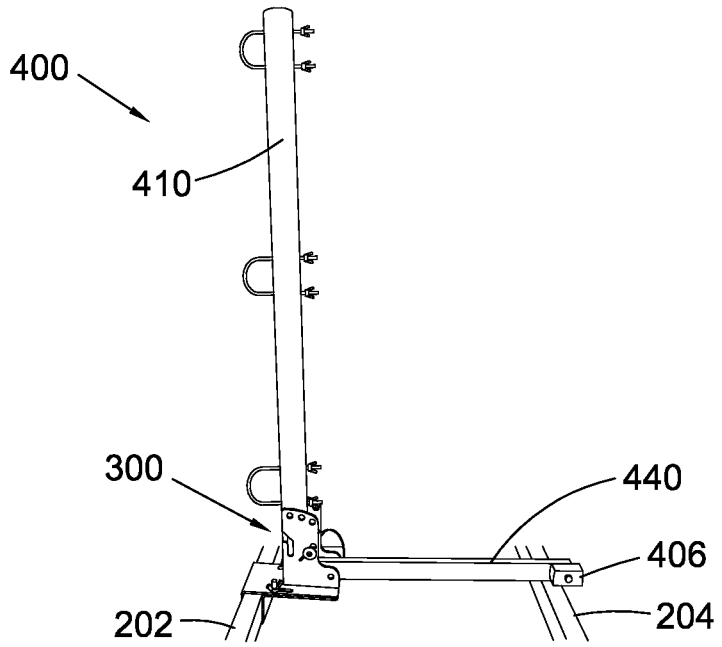
FIG. 9 shows the railing post of FIG. 8 secured within the railing post adaptor shown in FIG. 6.

FIG. 9 shows the railing post of FIG. 8 secured within the railing post adaptor shown in FIG. 6. The railing post 400 is inserted into the railing post adaptor 300 as described hereinbefore. In this particular example, the roof support apparatus comprises a first spar 202 and a second spar 204. The foot 446 of the support leg 440 rests against the second spar 204. The setup shown in FIG. 9 would be suitable for use for forming a safety barrier near an edge of a roof. The second spar 204 is arranged to be positioned nearer the edge of the roof than the first spar 202. When a force is applied (by a user intentionally or inadvertently) against the elongate member 410 of the railing post 400 in a direction towards the edge of the roof, the support leg 440 braces against the second spar 204 to support the elongate member 410 via the connection with the railing post adaptor 300.

It will be understood that the railing post adaptor 300 is configured such that it can be used to secure a railing post 400 thereto whilst only having access to an upper side of the roof support apparatus 200.

Figure 10:
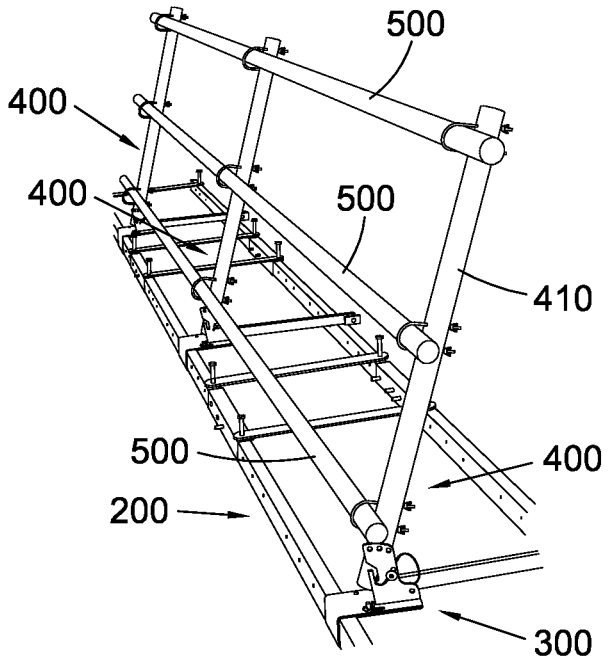
FIG. 10 shows one example configuration of a support apparatus having secured thereto a railing post via the railing post adaptor.

FIG. 10 shows one example configuration of a roof support apparatus having secured thereto a plurality of railing posts via a respective plurality of railing post adaptors. In this example, the railing post adaptors 300 are configured to secure the respective railing posts 400 such that the respective elongate members 410 are secured at an acute angle of approximately 80 degrees to the roof surface on which the roof support apparatus 200 is positioned. This allows the elongate member 410 of each railing post 400 to extend substantially vertically away from the roof surface, even when the roof surface is pitched. It will be understood that any number of pitched roof angles can be accommodated by providing appropriate opening(s) in the form of holes in the first and second side walls 332, 334 of the railing post adaptor 300. In some examples (not shown), the openings may be an arcuate slot engageable by a nut and bolt arrangement, whereby tightening of the nut and bolt can be used to frictionally secure the elongate member 410 at the desired angle. In general, connections between the railing post 400 and the railing post adaptor 300 that do not rely on a frictional tightening are preferred. As described previously, horizontal railing poles 500 can be secured between plural railing posts 400 to provide a safety barrier to prevent the inadvertent passage of a person therethrough. In this example, there are three horizontal railing poles 500, and each horizontal railing pole 500 is telescopically extendable to suit the length of safety railing required.

Figure 11:
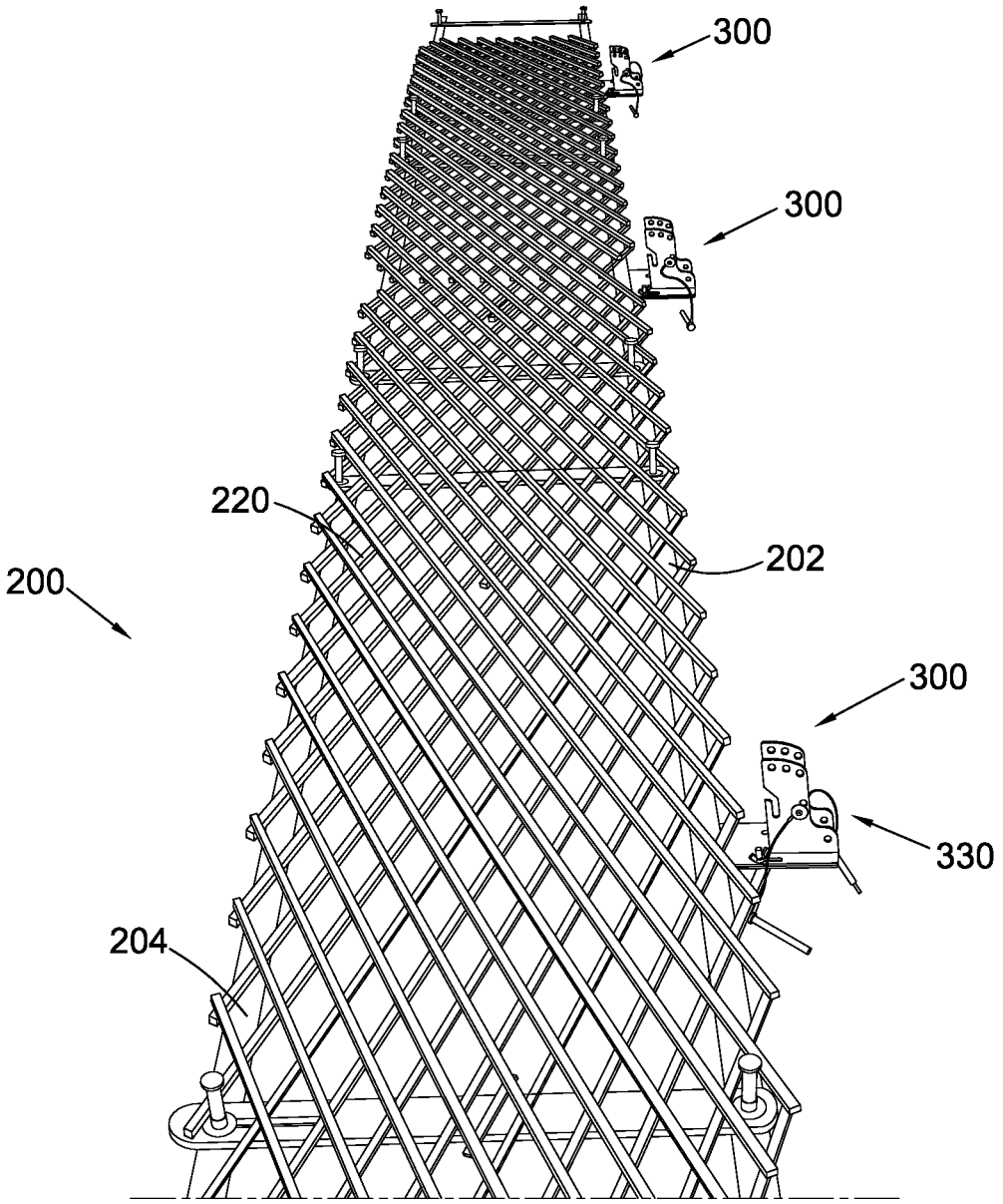
FIG. 11 shows an example configuration of a support apparatus having secured thereto a railing post adaptor prior to connection of a railing post thereto.

FIG. 11 shows an example configuration of a support apparatus having secured thereto a railing post adaptor prior to connection of a railing post thereto. The roof support apparatus 200 comprises a first spar 202 and a second spar 204. The first spar 202 has secured thereto three railing post adaptors 300. The railing post adaptors 300 are spaced apart. Conversely to the example shown in FIG. 10, the railing post adaptors 300 are secured such that the railing connection portion 330 is positioned on the opposite side of the first spar 202 to the second spar 204. In this way, the railing post adaptors 300 do not prevent the installation of a trellis mat 220 onto the first spar 202 and the second spar 204. In this configuration, the railing post adaptors 300 can be used to attach a railing post (not shown in FIG. 11) to the roof support apparatus covering a roof region, for example, a fragile roof region. It will be understood that the support leg of the railing post (see FIGS. 8 to 10 previously) can brace against a further portion of the roof to provide a stable safety rail.

In use, the railing post adaptor 300 is typically connected to the first spar 202 (or the second spar 204 of the roof support apparatus 200, and in the required position, before the roof support apparatus 200 is moved onto the roof. In this way, the roof support apparatus 200 is still lightweight, even with the railing post adaptor(s) connected thereto. The trellis mat 220 is also lightweight and is carried onto the roof separately and positioned onto the roof support apparatus 200. After this, the railing post(s) 400 are positioned in and secured to the railing post adaptors 300 to provide a safe working platform. This minimises the danger to a user using this roof support system to access a roof.

It will be understood that the roof support apparatus disclosed herein can be used on any type of roof and is not limited to use on a corrugated roof or to a fragile roof. A roof support apparatus is taken to include any support frame to be positioned directly on a roof and allowing a user to perform maintenance, building or other roof-based tasks therefrom.

In summary, there is provided a railing post adaptor (300) for a roof support apparatus (200). The roof support apparatus (200) comprises an elongate member (202, 204) having a plurality of longitudinal sides (231). The railing post adaptor (300) comprises a roof support apparatus connector (310) for securing the railing post adaptor (300) to the roof support apparatus (200). The roof support apparatus connector (310) comprises a first connection portion (312) arranged to engage, in use, with a first set of the plurality of longitudinal sides (231), and a second connection portion (314), movably mounted to the first connection portion (312) and arranged to engage, in use, with a second set of the plurality of longitudinal sides (231), the second set being different from the first set. The roof support apparatus connector (310) further comprises a railing connection portion (330) extending from the roof support apparatus connector (310) for detachably securing a proximal end (412) of a railing post (400) to the roof support apparatus (200) via the railing post adaptor (300). The first set and the second set each comprise at least two longitudinal sides (231). The first connection portion (312) and the second connection portion (314) are together configured to substantially prevent rotation of the railing post adapter (300) about a longitudinal axis of the elongate member (202, 204) by engagement with the first set and second set of longitudinal sides (231).

Throughout the description and claims of this specification, the words "comprise" and "contain" and variations of them mean "including but not limited to", and they are not intended to (and do not) exclude other integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers or characteristics described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

Clauses:

1. A support apparatus for a corrugated roof comprising:
a first spar;
a second spar parallel to the first spar;
at least one connection member extending from the support apparatus in a first direction substantially normal to a plane intersecting the first spar and the second spar, the at least one connection member being configured to connect the support apparatus to a support platform; and
a link member connecting the second spar to the first spar and spacing the second spar from the first spar.

2. A support apparatus as described in clause 1, wherein the link member is movable relative to at least one of the first spar and the second spar whereby to vary the spacing of the second spar from the first spar.

3. A support apparatus as described in clause 2, wherein the link member pivotably connects the first spar to the second spar.

4. A support apparatus as described in clause 2 or clause 3, wherein the link member extensibly connects the first spar to the second spar.

5. A support apparatus as described in clause 4, wherein the link member has defined therein an elongate slot arranged to engage with a corresponding pin provided on the second spar.

6. A support apparatus as described in clause 5, wherein the corresponding pin is the connection member.

7. A support apparatus as described in any of clauses 2 to 6, wherein an end of the link member is configured to be extensibly fixed relative to the first spar.

8. A support apparatus as described in any preceding clause, wherein the connection member is a pin.

9. A support apparatus as described in any preceding clause, wherein the first spar and the second spar extend at least partially from the link member in a second direction, opposite the first direction.

10. A support apparatus as described in any preceding clause, wherein a length of the first spar and the second spar is longer than a length of the link member.

11. A support apparatus as described in any preceding clause, wherein the support apparatus comprises a plurality of link members.

12. A support apparatus as described in any preceding clause, wherein each of the first spar and the second spar has extending therefrom at least one connection member.

13. A support apparatus as described in clause 12, wherein the connection members are connected to the link members.

14. A support apparatus as described in any preceding clause, wherein at least one of the first spar and the second spar comprise a joining member configured to join the support apparatus to a further support apparatus.

15. A support apparatus as described in clause 14, wherein the joining member is a sleeve member arranged to fit over an end of the first spar or the second spar.

16. A support apparatus as described in any preceding clause, wherein the support apparatus further comprises a support platform configurable to be connected to the support apparatus by the connection member.

17. A support apparatus as described in clause 16, wherein the support platform is a trellis mat.

The invention claimed is:

1. A railing post adaptor for a roof support apparatus, the roof support apparatus including an elongate member having longitudinal sides and an elongate member longitudinal axis, the railing post adaptor comprising:

a roof support apparatus connector for securing the railing post adaptor to the roof support apparatus, the roof support apparatus connector including:

a first connection portion arranged to engage, in use, with a first set of the longitudinal sides; and a second connection portion movably mounted to the first connection portion and arranged to engage, in use, with a second set of the longitudinal sides, wherein the second set is different from the first set, and the first and second sets each includes at least two longitudinal sides;

a railing post having a railing post proximal end and a bracing leg pivotably connected at a bracing leg proximal end to the railing post proximal end, wherein the bracing leg has a connection member; and a railing connection portion extending from the roof support apparatus connector for detachably securing the railing post proximal end to the roof support apparatus via the railing post adaptor, wherein the railing connection portion includes first and second side walls spaced from each other, extending away from the roof support apparatus connector, and adapted to detachably secure the railing post proximal end therebetween, wherein at least one of the first and second side walls has defined therein a leg support opening for engagement with the connection member to secure the bracing leg at a predetermined angle relative to the railing post, and wherein the first and second connection portions are adapted to cooperatively substantially prevent rotation of the railing post adapter about the elongate member longitudinal axis by engagement with the first and second sets.

2. The railing post adaptor as claimed in claim 1, wherein, in use, the elongate member is located between the first and second connection portions.

3. The railing post adaptor as claimed in claim 1, wherein the railing post adaptor is sized to correspond with a predetermined size of the elongate member.

4. The railing post adaptor as claimed in claim 1, wherein the first connection portion has defined therein a locating opening, and the second connection portion includes a locating protrusion sized to fit within the locating opening, and wherein, when the locating protrusion is disposed within the locating opening, the first connection portion is substantially fixed relative to the second connection portion in any direction transverse to an axial direction of the locating opening.

5. The railing post adaptor as claimed in claim 1, wherein the first connection portion has defined therein an elongate slot, wherein the second connection portion includes a protrusion sized to fit within the elongate slot, and, when the protrusion is disposed within the elongate slot, the first connection portion is slidably mounted to the second connection portion, whereby to vary a spacing between a first connection surface of the first connection portion and a second connection surface of the second connection portion, and wherein the first and second connection surfaces are adapted to respectively engage one of the first and second sets.

6. The railing post adaptor as claimed in claim 5, wherein the protrusion is a threaded protrusion, and wherein the railing post adaptor further includes a threaded fastener having internal threads for engagement with the threaded protrusion to secure the first connection portion to the second connection portion.

7. The railing post adaptor as claimed in claim 1, wherein the elongate member has a substantially rectangular cross-section in a direction transverse to a longitudinal direction.

8. The railing post adaptor as claimed in claim 1, wherein the first and second connection portions are each formed from sheet metal.

9. The railing post adaptor as claimed in claim 1, wherein the first connection portion extends around only a part of one of the longitudinal sides of the first set, in a direction transverse to a longitudinal direction of the elongate member.

10. The railing post adaptor as claimed in claim 9, wherein the second connection portion does not engage with the one of the longitudinal sides of the first set.

11. The railing post adaptor as claimed in claim 1, wherein the railing connection portion extends from the first connection portion.

12. The railing post adaptor as claimed in claim 1, wherein the railing connection portion detachably secures the railing post proximal end to the roof support apparatus such that a railing post longitudinal axis is offset in a direction transverse to the elongate member longitudinal axis.

13. The railing post adaptor as claimed in claim 1, wherein the first and second side walls extend substantially transverse to the elongate member longitudinal axis.

14. The railing post adaptor as claimed in claim 1, wherein the first and second side walls each has defined therein an elongate slot, open to a boundary of the respective first and second side walls, each of the elongate slots adapted to engage locating members extending transversely from the railing post.

15. The railing post adaptor as claimed in claim 14, wherein at least one of the first and second side walls has defined therein a mutually spaced further locating holes, spaced from the elongate slot, for engagement with a railing post connection member, whereby to vary a pitch of the railing post relative to the roof support apparatus connector.

16. The railing post adaptor as claimed in claim 1, wherein the railing post includes at least one barrier connection member for connecting the railing post to a barrier member that spans adjacent railing posts that are connected to the roof support apparatus.

17. The railing post adaptor as claimed in claim 16, wherein the at least one barrier connection member is a loop member, and wherein the at least one barrier member is a railing pole configured to be arranged substantially parallel to a roof in use.

18. The railing post adaptor as claimed in claim 1, wherein a pivotable foot is provided at a distal end of the bracing leg.

19. A kit of parts for a roof support apparatus, the kit of parts comprising:

a first elongate member having first longitudinal sides and a first elongate member longitudinal axis;

a second elongate member having second longitudinal sides;

a link member adapted to space the first and second elongate members such that the first and second elongate members are mutually parallel;

a railing post adaptor including a roof support apparatus connector for securing the railing post adaptor to the first elongate member, the roof support apparatus connector including:

a first connection portion arranged to engage, in use, with a first set of the first longitudinal sides; and a second connection portion movably mounted to the first connection portion and arranged to engage, in use, with a second set of the first longitudinal sides, wherein the second set is different from the first set, and the first and second sets each includes at least two longitudinal sides;

a railing post having a railing post proximal end and a bracing leg pivotably connected at a bracing leg proximal end to the railing post proximal end, wherein the bracing leg has a connection member; and a railing connection portion extending from the roof support apparatus connector for detachably securing the railing post proximal end to the roof support apparatus via the railing post adaptor, wherein the railing connection portion includes first and second side walls spaced from each other, extending away from the roof support apparatus connector, and adapted to detachably secure the railing post proximal end therebetween, wherein at least one of the first and second sidewalls has defined therein a leg support opening for engagement with the connection member to secure the bracing leg at a predetermined angle relative to the railing post, and wherein the first and second connection portions are adapted to cooperatively substantially prevent rotation of the railing post adapter about the first elongate member longitudinal axis by engagement with the first and second sets.

* * * * *